US006416587B1

(12) United States Patent
Lu et al.

(10) Patent No.: US 6,416,587 B1
(45) Date of Patent: Jul. 9, 2002

(54) APPARATUS AND METHOD FOR CLEANING WAFER

(75) Inventors: Wen-Jang Lu; Yi-Ta Tsou; Hui-Xiu Tang, all of Chutung Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 0 days.

(21) Appl. No.: 09/536,157

(22) Filed: Mar. 28, 2000

(51) Int. Cl.[7] ..... B08B 3/02

(52) U.S. Cl. ..... 134/2; 134/902; 134/32; 134/34; 134/36; 438/906

(58) Field of Search ..... 134/1.3, 22.18, 134/24, 32, 34, 36, 902, 2; 438/906

(56) References Cited

U.S. PATENT DOCUMENTS 5,181,985 A * 1/1993 Lampert et al. ..... 156/635
5,186,192 A * 2/1993 Netsu et al. ..... 134/68
5,361,789 A * 11/1994 Yoshida et al. ..... 134/68
5,395,482 A * 3/1995 Onda et al. ..... 156/646
5,578,529 A * 11/1996 Mullins ..... 437/228
5,779,816 A * 7/1998 Trinh ..... 134/23
5,964,952 A * 10/1999 Kunze-Concewitz ..... 134/2
5,992,431 A * 11/1999 Weber et al. ..... 134/135
6,006,736 A * 12/1999 Suzuki et al. ..... 125/13.02
6,145,519 A * 11/2000 Konishi et al. ..... 134/95.2
6,156,153 A * 12/2000 Iwamoto et al. ..... 156/345
6,225,235 B1 * 5/2001 Kunze-Concewitz ..... 438/745
6,230,753 B1 * 5/2001 Jones et al. ..... 139/1.3
6,235,147 B1 * 5/2001 Lee et al. ..... 156/345
6,273,107 B1 * 8/2001 Adams et al. ..... 134/102.1

* cited by examiner

*Primary Examiner*—Randy Gulakowski
*Assistant Examiner*—J Smetana
(74) *Attorney, Agent, or Firm*—Bacon & Thomas, PLLC

(57) ABSTRACT

A wafer cleaning apparatus includes a rinsing container in which wafers to be cleaned are positioned and four sets of nozzles arranged in the rinsing container to be symmetric with respect to each other. The nozzles generate water jets toward the wafers for performing a wafer cleaning process. In a first phase of the wafer cleaning process, the first nozzle set and the fourth nozzle set are turned on to generate water jets in diagonally opposite directions with respect to the wafers for a given period. In a second phase, the second nozzle set and the third nozzle set are turned on to generate water jets in diagonally opposite directions with respect to the wafers for a given period. In a third phase, the third nozzle set and the fourth nozzle set are turned on to cause an up-rising water flow from a bottom of the container to a top open side thereof for expelling contaminants dissolved or suspended in the water out of the container.

5 Claims, 13 Drawing Sheets

APPARATUS AND METHOD FOR CLEANING WAFER

BACKGROUND OF THE INVENTION

1. Field of the Invention

The present invention generally relates to an apparatus and method for cleaning semiconductor wafers, and in particular to an apparatus for cleaning the wafers with less water consumption and a cleaning method for more effectively cleaning the wafers by means of four sets of water jet generating means arranged to be symmetric with respect to each other for generating water jets toward the wafers.

2. Description of the Prior Art

Semiconductor industry is a highly water-consuming industry in which a great amount of water is used to clean wafers. With the development and improvement of sub-micro meter semiconductor manufacturing techniques, the size of wafers and the number of semiconductor factories are being increased. Thus, the consumption of water is increased too. A major issue of the semiconductor industry is to reduce the water consumption for both economic and environmental purposes.

Conventionally, the wafers are placed in a rinsing bath, then pumping water and nitrogen gas continuously form the bottom into the bath, making the water overflowing out of the bath for cleaning wafers. The purpose for rinsing wafers is bringing debris and contaminant away from the surface of the wafers by overflowing water and preventing the wafers being second polluted in the cleaning process.

Two types of conventional wafer cleaning systems are known in the art. One is a plug-flow system and the other is CSTR system. Hybrid systems of the two systems are also known. The plug-flow system provides the most efficient way for cleaning wafers, while the CSTR system has a small size. However, both systems consume a great amount of water.

FIGS. 1 and 2 of the attached drawings show a conventional wafer cleaning apparatus 1 comprising a rinsing container 5 in which two parallel water pipes 21 and 22 are arranged. A gas pipe 3 is also arranged in the rinsing container 5 between the water pipes 21 and 22. One end of each water pipe 21 and 22 is closed with water fed into the pipe 21 and 22 through an opposite open end. Similarly, one end of the gas pipe 3 is closed with nitrogen gas fed into the gas pipe 3 through an opposite open end. A number of V-shaped notches are formed on the top edge of each side wall of the rinsing container for water overflowing and bringing debris and contaminant out of the rinsing container 5.

Wafers 4 to be cleaned are disposed into the rinsing container 5 by cassettes, trays, or racks. A gap of a predetermined width, such as 0.6 mm, is formed between adjacent wafers 4. Conventionally, fifth wafers are positioned in the rinsing container 5 in a batch to be simultaneously cleaned thereby.

Each water pipe such as pipe 21 is formed with two holes 211 and 212 spaced at a predetermined distance as shown in FIG. 3A. Water is fed into the rinsing container 5 through the holes 211 and 212. FIG. 3B is a cross-sectional view of the water pipe 21 in which the holes 211 are located in the fourth quadrant at 315 degree position, while the holes 212 are located in the third quadrant at 240 degree position.

As shown in FIG. 3C, holes 31 are defined in the gas pipe 3 at predetermined distance through which nitrogen gas is supplied into the rinsing container 5. The gas that is fed into the container 5 causes an up-rising water flow that moves into the gaps between the wafers to clean the wafers and move debris therefrom. However, due to the uncontrollable water flow in and out of the gaps between wafers, it often occurs that the wafers are not completely cleaned. Thus, extended cleaning period is required to have the wafers completely cleaned. This reduces the operation efficiency of the wafer cleaning apparatus and increases the consumption of water.

Furthermore, water must be kept flowing in the rinsing container in order to control or reduce the population of bacteria. In the plug-flow system, most of the water flows between the wafers and the side walls of the container rather than through the gaps between wafers. In addition, the water flow is often diverted at the edges of the wafers. Thus, the wafers cannot be effectively cleaned.

It is thus desirable to have a wafer cleaning apparatus capable to operate in more efficient manner with less consumption of water for overcoming the above mentioned problems.

SUMMARY OF THE INVENTION

Accordingly, an object of the present invention is to provide a wafer cleaning apparatus operable in a more efficient manner with less water consumption. The wafer cleaning apparatus includes multiple water jet generating means arranged to be symmetric with respect to each other for generating water jets toward a number of wafers to perform a wafer cleaning operation.

To achieve the above objects, in accordance with the present invention, there is provided a wafer cleaning apparatus comprising a rinsing container in which wafers to be cleaned are positioned and four sets of nozzles are arranged at four diagonal corners of a rinsing container to be alternately actuated for effectively cleaning wafers. In a first phase of the wafer cleaning process, the first nozzle set and the fourth nozzle set are turned on to generate water jets in diagonally opposite directions with respect to the wafers for a given period. In a second phase, the second nozzle set and the third nozzle set are turned on to generate water jets in diagonally opposite directions with respect to the wafers for a given period. In a third phase, the third nozzle set and the fourth nozzle set are turned on to cause an up-rising water flow from a bottom of the container to a top open side thereof for expelling contaminants dissolved or suspended in the water out of the container.

Preferably, in accordance with the present invention, the wafers to be cleaned are moved into the rinsing container by a receiving cassette, a supporting tray or a suspension frame that receives and retains the wafers therein. The wafers are arranged to have a primary surface thereof facing a center of the rinsing container.

Preferably, the nozzles are preferably controlled by a programmable logic control (PLC) based control device to generate water jets toward the wafers for performing a wafer cleaning process.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
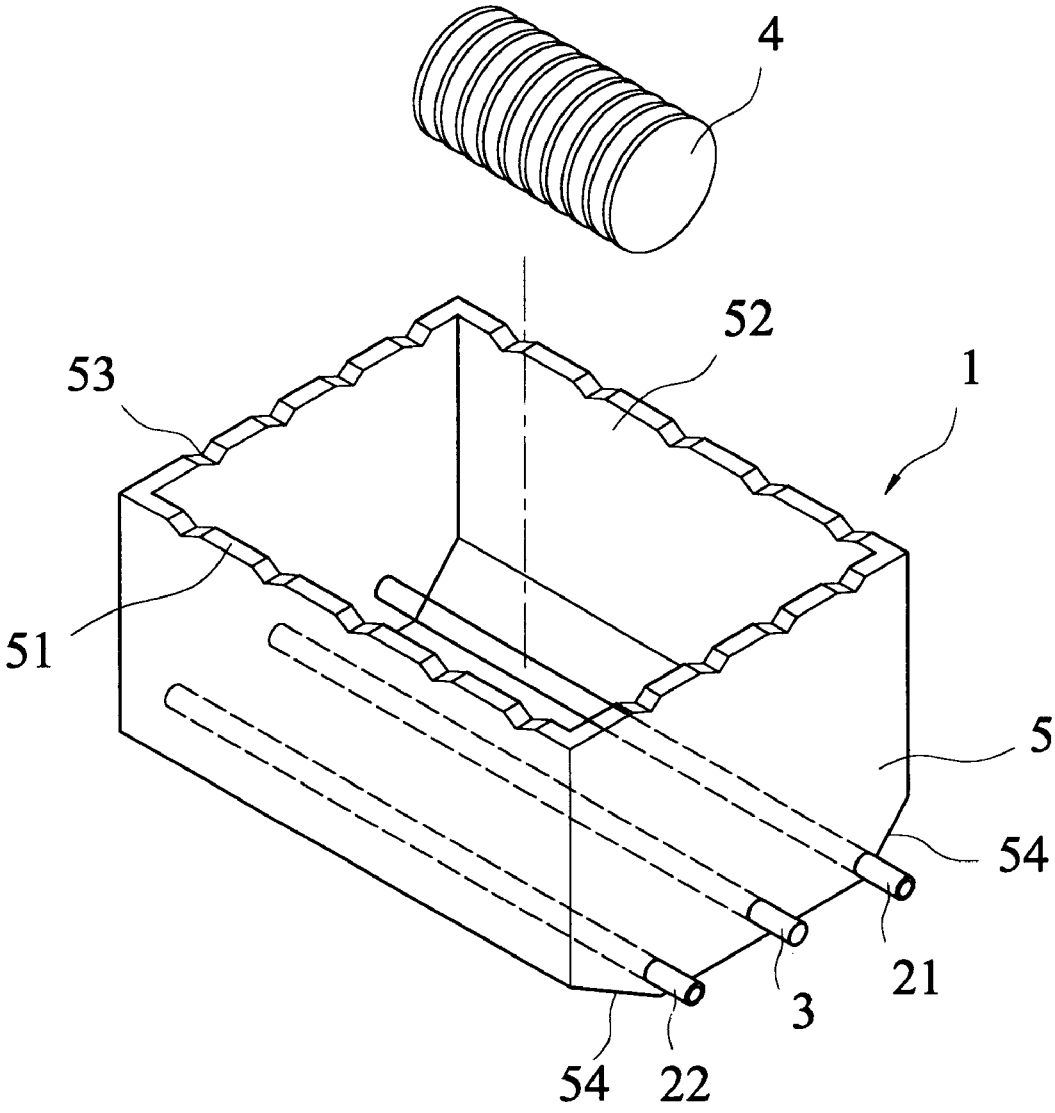
FIG.1(PRIOR ART)
FIG. 1 is a perspective view of a conventional wafer rinsing container with water pipes and a gas pipe arranged therein.
Figure 2:
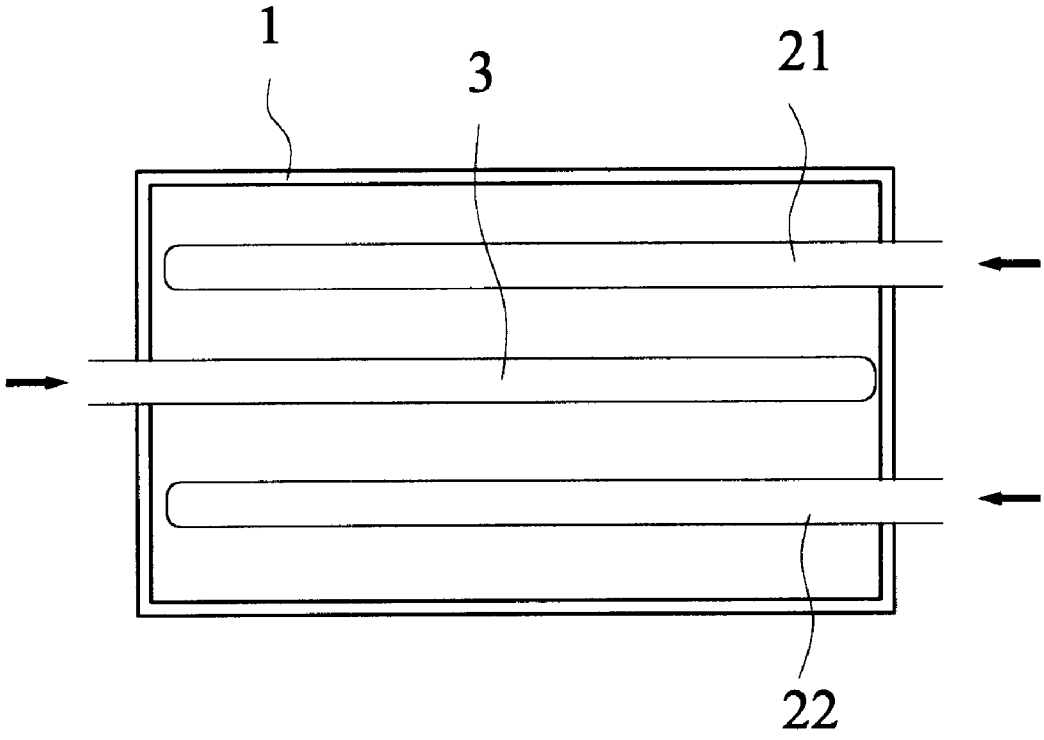
FIG.2(PRIOR ART)
FIG. 2 is a top view of the conventional wafer-rinsing container.
Figure 3A:
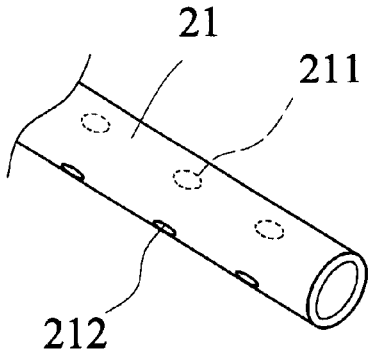
FIG.3A(PRIOR ART)
FIG. 3A is a perspective view of a portion of the water pipe arranged in the conventional wafer-rinsing container.
Figure 3B:
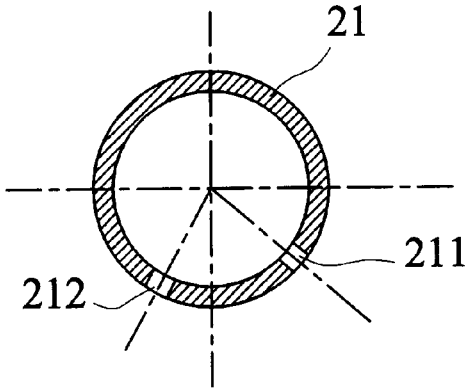
FIG.3B(PRIOR ART)
FIG. 3B is a perspective view of a portion of the gas pipe arranged in the conventional wafer-rinsing container.
Figure 3C:
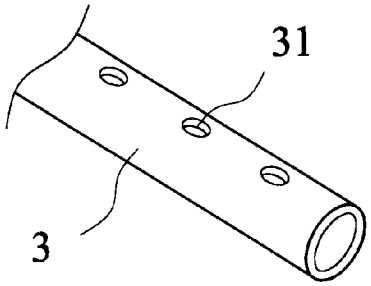
FIG.3C(PRIOR ART)
FIG. 3C is a cross-sectional view of the gas pipe of FIG. 3B.
Figure 4:
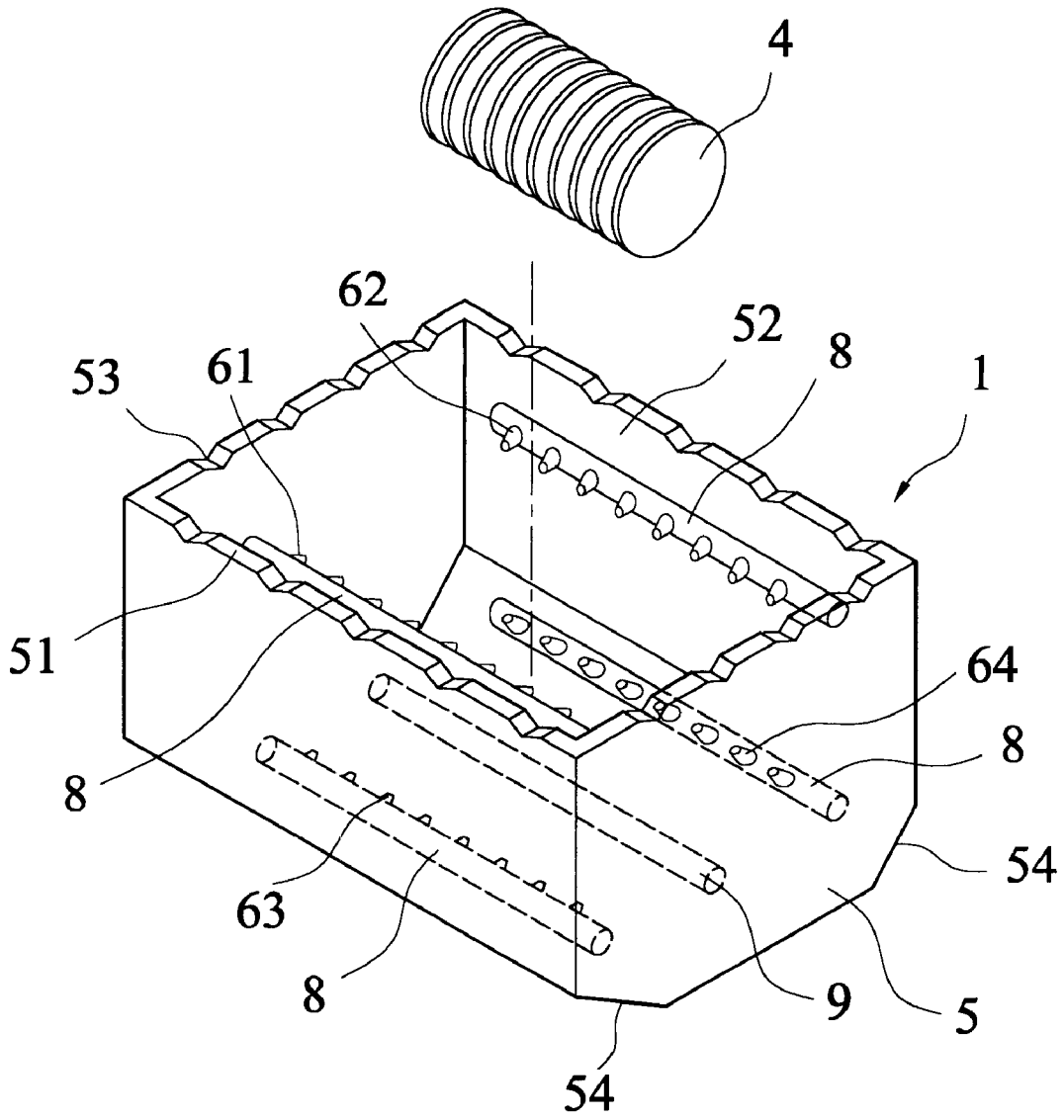
FIG. 4 is a perspective view of a wafer cleaning apparatus constructed in accordance with a first embodiment of the present invention.

With reference to the drawings and in particular to FIG. 4, a wafer cleaning apparatus 1 constructed in accordance with a first preferred embodiment of the present invention is shown. Wherever possible, the same reference numbers will be used throughout the drawings to refer to the same or like parts.

The wafer cleaning apparatus 1 comprises a rising container 5 having four side walls forming a top open side defined by top edges of the side walls for receipt of wafers 4 to be cleaned and a closed bottom between bottom edges of the side walls.

A gas pipe 9 is arranged on the bottom of the rising container 5, preferably substantially at a center thereof. Holes (not labeled) are defined in the gas pipe 9 for supplying gas, such as nitrogen, into the rinsing space of the rinsing container 5.

Four water pipes 8 are arranged inside the rising container 5 of which two (lower water pipes) are on the bottom of the rising container 5, preferably on opposite sides of the gas pipe 9 and the remaining two (upper water pipes) are located by first and second longitudinal side walls 51, 52 of the container 5 proximate the open top side.

First and second water jet generating means respectively comprising first nozzles 61 and second nozzles 62 are respectively formed on and in flow communication with the upper water pipes 8. The first and second nozzles 61, 62, are downwardly inclined such that water jets are generated thereby in directions toward a center of the rinsing space.

Third and fourth water jet generating means respectively comprising third nozzles 63 and fourth nozzles 64 are respectively formed on and in flow communication with the lower water pipes 8 and are oriented upwardly inclined for generating water jets in directions toward the center of the rinsing space. Preferably, the nozzles 61, 62, 63 and 64 are arranged to be symmetric with respect to each other. The first and fourth nozzles 61 and 64 are diagonally opposite each other while the second and third nozzles 62 and 63 are diagonally opposite each other.

Figure 6:
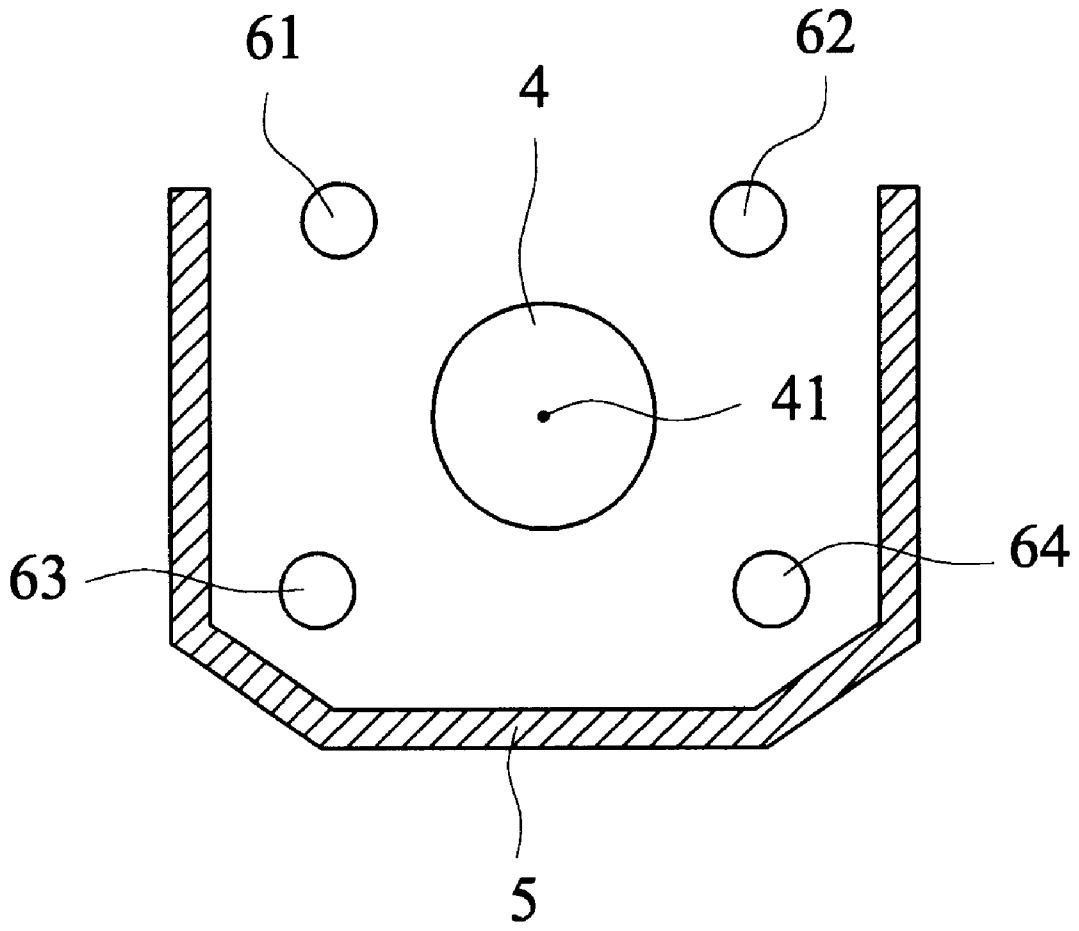
FIG. 6 is a cross-sectional view of the wafer cleaning apparatus of the present invention.

The wafers 4 to be cleaned are supported in the rinsing space of the rinsing container 5 by any suitable means as shown in FIG. 6 at a position substantially centered between the water pipes 8 whereby the nozzles 61, 62, 63 and 64 generate water jets into the rinsing space toward the wafers 4 to clean the wafers 4. The water jets impacts the wafers 4 and causes water flowing through gaps between the wafers 4 for effectively cleaning the wafers 4 and bringing away contaminants (such as HCl, $H_2SO_4$, $NH_4OH$, HF and tiny particles) from surfaces of the wafers 4.

Figure 5:
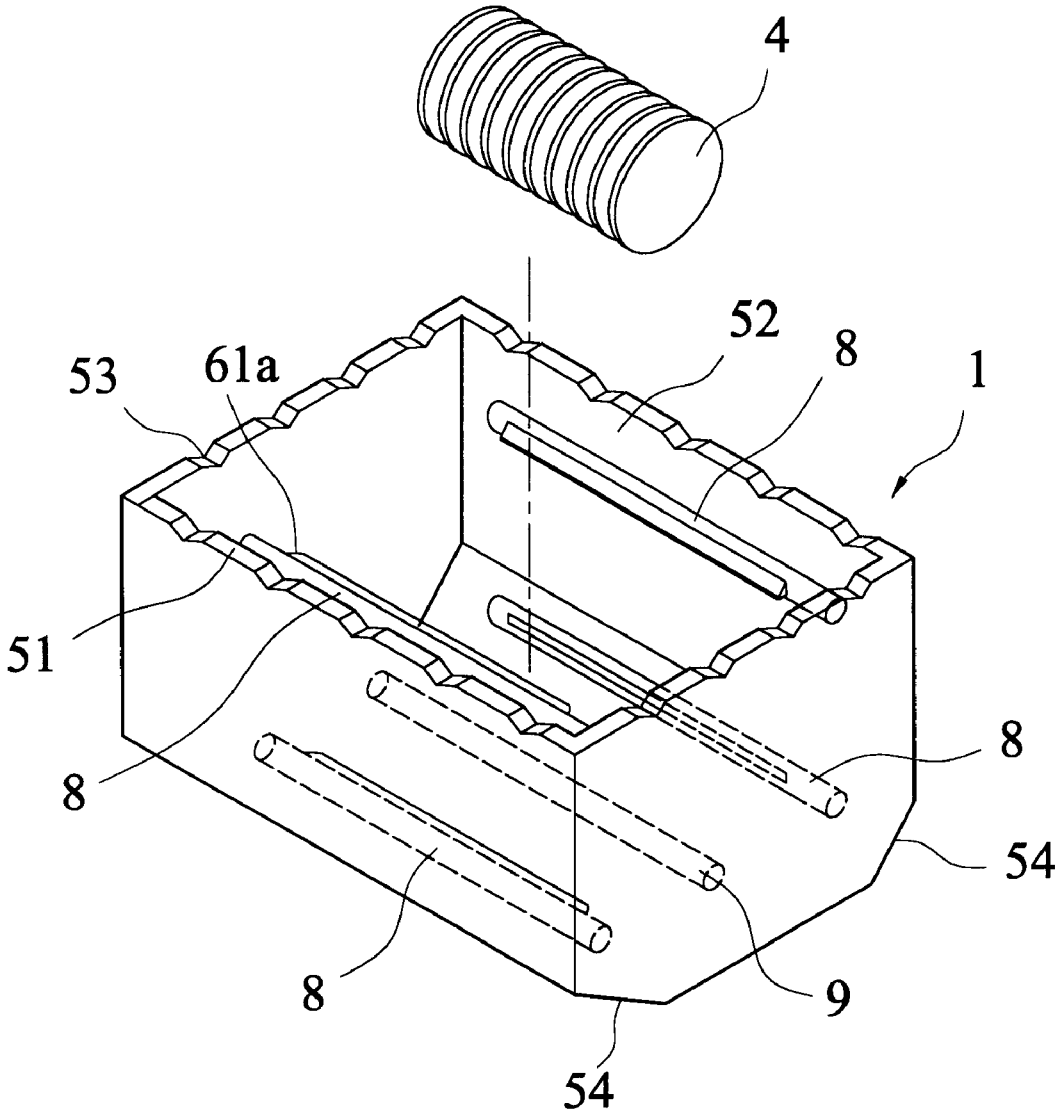
FIG. 5 is similar to FIG. 4 but showing a wafer cleaning apparatus in accordance with a second embodiment of the present invention.

As a simple modification of the embodiment shown in FIG. 4, the nozzles 61, 62, 63 and 64 may be replaced by an elongate slit 61*a* defining in and extending along a portion of each water pipe 8 as shown in FIG. 5. The slit 61*a* generates a high-speed water stream into the rinsing space for effectively bringing away contaminants from the wafers thereby cleaning the wafers 4.

It is noted that the water pipes 8 may not need to be arranged inside the rinsing container 5. However, the nozzles 61, 62, 63 and 64 must be positioned inside the rinsing container 5 for generating high-speed water streams.

As shown in FIGS. 4 and 6, the nozzles 61, 62, 63 and 64 are oriented toward a center 41 of the wafers 4 when the wafers 4 are positioned in the rinsing space. The first nozzles 61 are arranged opposite the fourth nozzles 64, while the second and third nozzles 62 and 63 are opposite to each other. High-pressure water is supplied into the water pipes 8 causing high-speed water jets at the nozzles 61, 62, 63 and 64. The water jets are directed to the wafers 4 and flow into gaps between adjacent wafers 4 for effectively bringing contaminants away from the wafers 4 and accelerate diffusion of the contaminant into the water thereby enhancing the efficiency of the cleaning operation.

V-shaped notches 53 are defined in the top edges of the side walls of the rinsing container 5 for overflowing the water supplied into the rinsing container 5 via the water pipes 8. Preferably, the notches 53 are equally spaced. Furthermore, the rinsing container 5 may also form inclined wall sections between the side walls and the bottom thereof for preventing deposition of the contaminants removed from the wafers 4.

Figure 7:
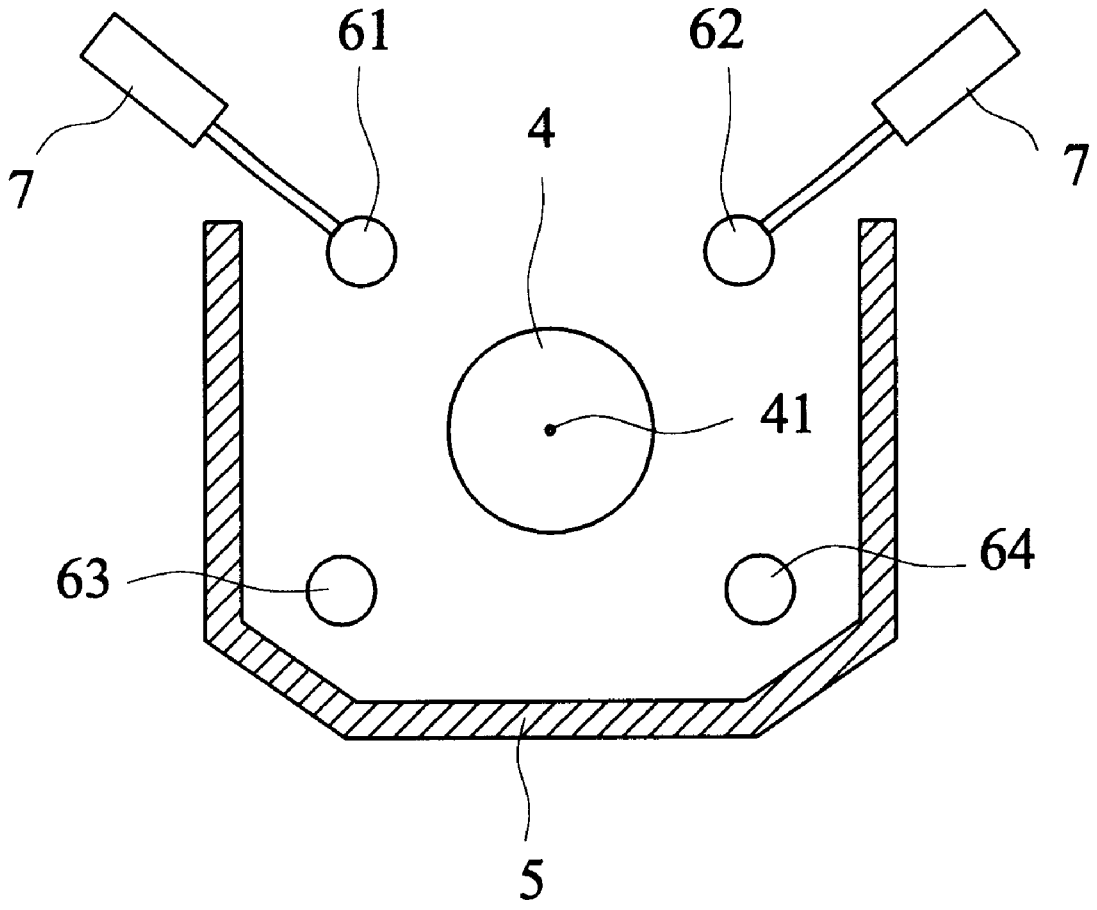
FIG. 7 is a cross-sectional view of a wafer cleaning apparatus constructed in accordance with a third embodiment of the present invention.

For adjusting the locations of the upper water pipes 8, as illustrated in a third embodiment of the present invention shown in FIG. 7, the upper water pipes 8 are attached to positioning means 7 which, when actuated, moves the upper water pipes 8 with respect to the rinsing container 5 and the wafers 4. The positioning means 7 may comprise linear motion system, such as hydraulic cylinder and pneumatic cylinder (as shown in FIGS. 8A–8F), or rotary motion system, such as electrical motors with transmissions or other rotary devices (as shown in FIGS. 9A–9F). Other mechanical arrangement capable of moving the upper water pipes 8 may also be employed. Similarly and if desired, the lower water pipes 8 may also be provided with similar positioning means.

In case that the water pipes 8 are not arranged inside the rinsing container 5 while the nozzles 61, 62, 63 and 64 are within the rinsing container 5, the positioning means 7 may be coupled to the nozzles 61, 62, 63 and 64 for moving the nozzles 61, 62, 63 and 64 with respect to the rinsing container 5.

The positioning means 7 allows the positions of the water pipes 8 or the nozzles 61, 62, 63 and 64 with respect to the wafers 4 to be adjustable. Furthermore, the positioning means 7 may also be helpful in facilitating positioning the wafers 4 into the rinsing container 5 by temporarily moving the upper water pipes 8 or the nozzles 61 and 62 associated therewith out of the rinsing container 5 as shown in FIGS. 8A, 8E and 8F or FIGS. 9A, 9E and 9F. The upper water pipes 8 or nozzles 61 and 62 may then be moved back into the rinsing container 5 for performing cleaning operation, as shown in FIGS. 8B, 8C and 8D or FIGS. 9B, 9C and 9D.

Figure 8A:
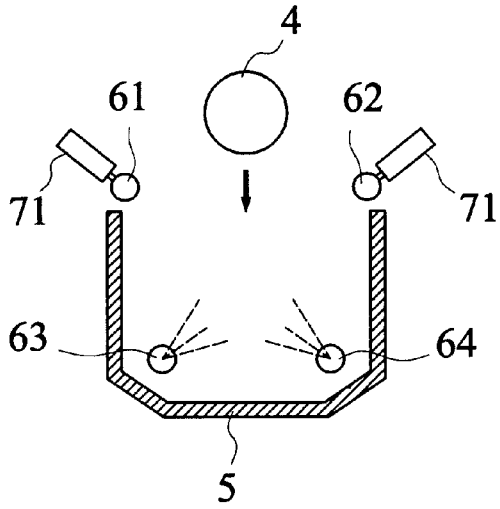
FIGS. 8A to 8F are cross-sectional views showing in sequence a cleaning process by the wafer cleaning apparatus of the present invention equipped with a linear motion based positioning device.
Figure 8B:
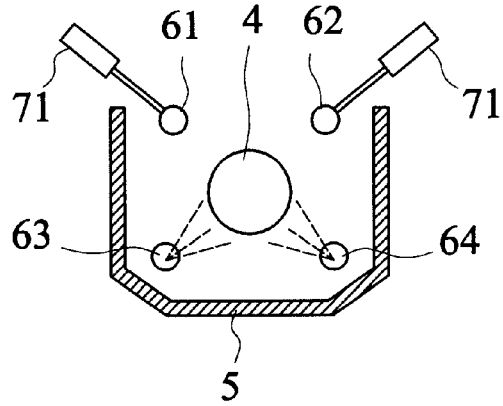

FIGS. 8A to 8F shows the steps of cleaning wafers 4 with the wafer cleaning apparatus 1 of the present invention. In FIG. 8A, the upper (the first and the second) nozzles 61 and 62 are moved out of the rinsing container 5 for positioning the wafers 4 into the rising container 5. At this moment, the lower (the third and the fourth) nozzles 63 and 64 continuously generate water jets as indicated by broken lines for causing an up-rising water flow inside the rinsing container 5. When the wafers 4 reach the predetermined position inside the rinsing container 5 as shown in FIG. 8B, the upper nozzles 61 and 62 are moved back into the rinsing container 5 by the positioning means 7 to a position substantially symmetric with respect to the lower nozzles 63 and 64.

Figure 8C:
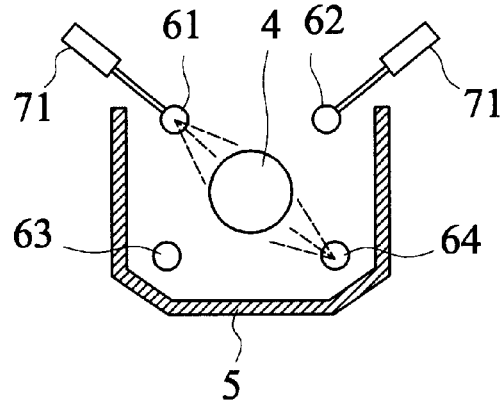
Figure 8D:
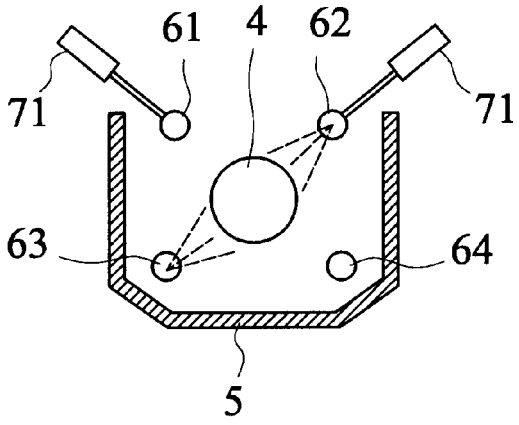

Thereafter, while the fourth nozzles 4 remain open, the third nozzles 63 are turned off and the first nozzles 61 are turned on for the first phase of the cleaning operation shown in FIG. 8C. After a predetermined time lapse, the first and fourth nozzles 61 and 64 are turned off and the second and third nozzles 62 and 63 are turned on, as shown in FIG. 8D. This is the second phase of the cleaning operation.

Figure 8E:
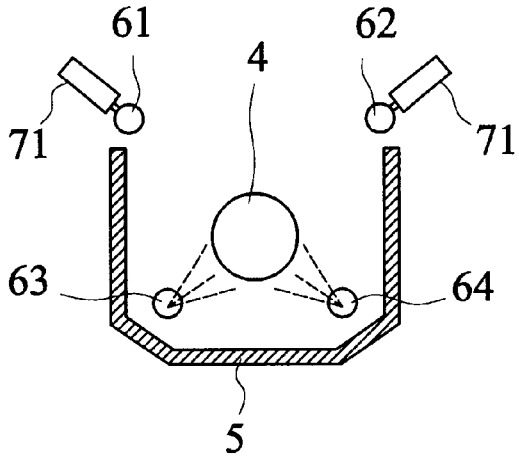
Figure 8F:
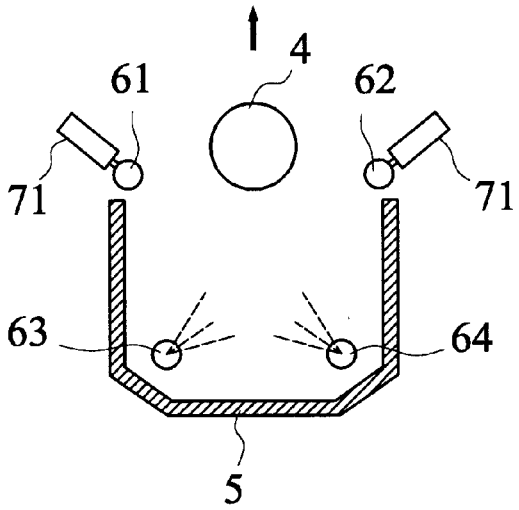
Figure 9A:
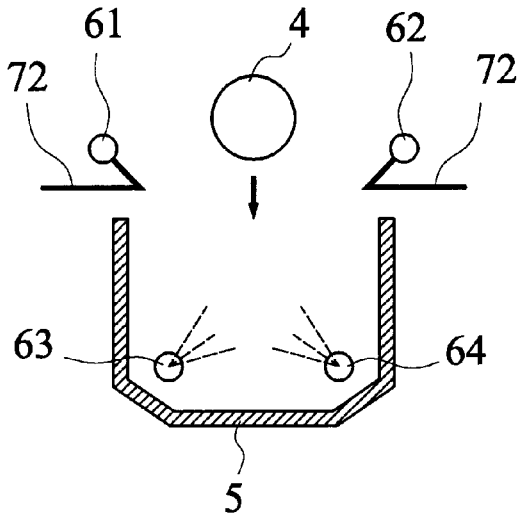
FIGS. 9A to 9F are cross-sectional views showing in sequence a cleaning process by the wafer cleaning apparatus of the present invention equipped with a rotary motion based positioning device.
Figure 9B:
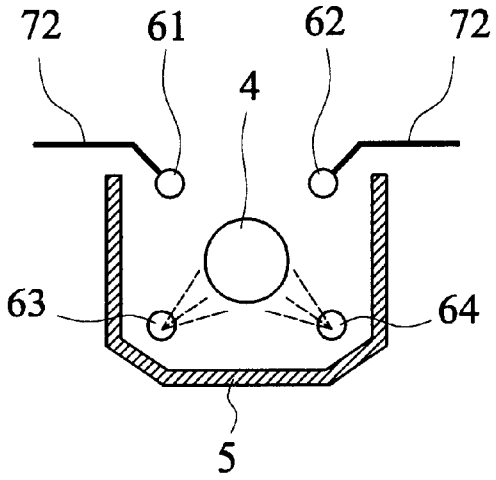
Figure 9C:
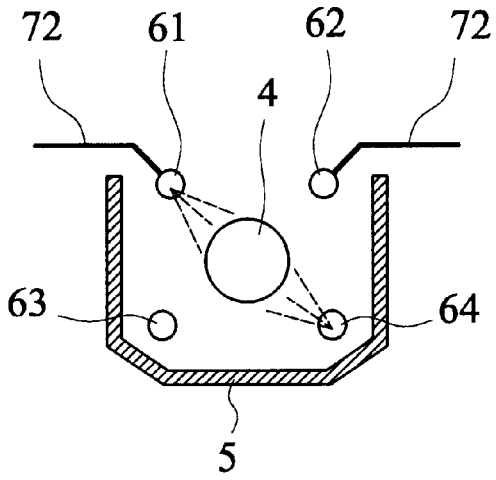
Figure 9D:
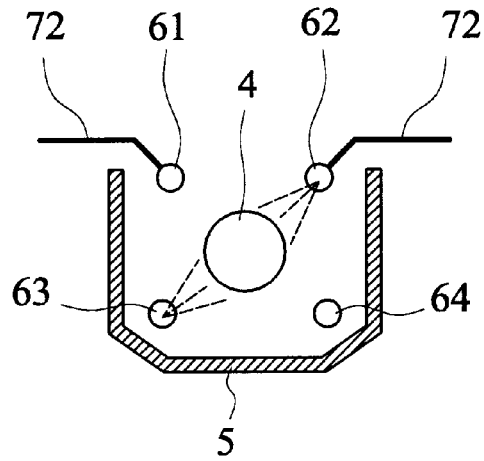
Figure 9E:
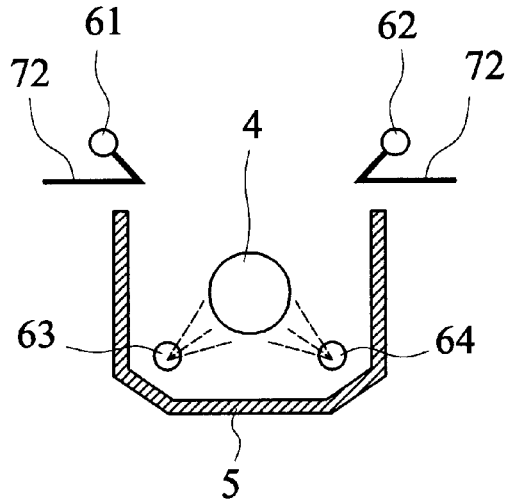
Figure 9F:
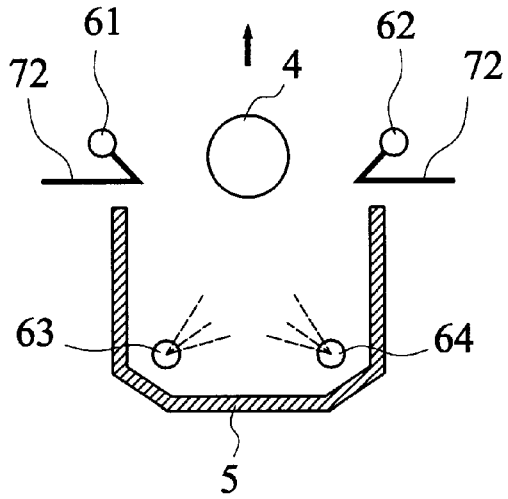

After a predetermined time period, as a third phase of the cleaning operation, the second nozzles 62 are turned off and the fourth nozzles 64 are turned on as shown in FIG. 8E. The third and fourth nozzle 63 and 64 cause an up-rising water flow for further moving contaminants from the wafers 4 out of the container 5 and preventing the contaminant from being deposited on the bottom of the container 5. Thereafter, the upper nozzles 61 and 62 are moved out of the rinsing container 5 by the positioning means 7 for facilitating removing the wafers 4 out of the rinsing container 5 as shown in FIG. 8F.

If desired, the first and second phases may be cyclically and alternately repeated several times. Furthermore, the third phase may also be performed at selected sequence after the first and second phases are repeated several times.

FIGS. 9A to 9F are similar to and corresponding to FIGS. 8A to 8F with the only difference being that the linear motion system of the positioning means 7 is replaced by a rotary motion system. Thus, no further detail is needed herein.

Figure 10:
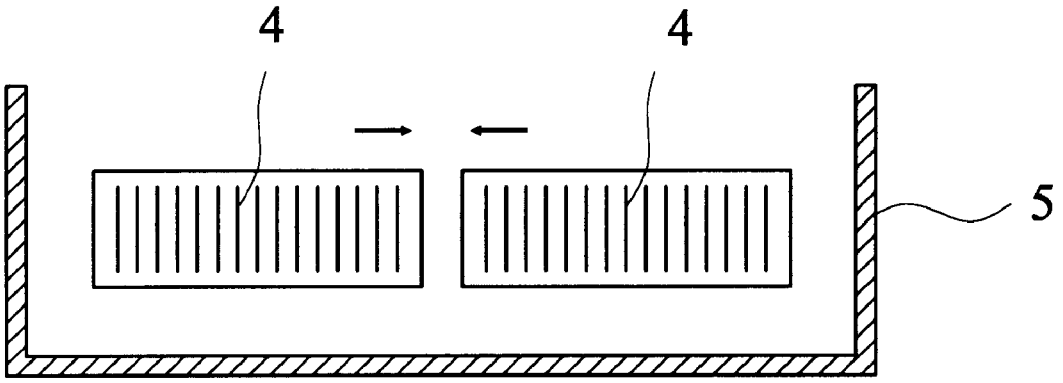
FIG. 10 is a top view showing the arrangement of wafers to be cleaned by the wafer cleaning apparatus of the present invention.

FIG. 10 shows an arrangement of a number of wafers 4 to be cleaned simultaneously as a batch by the wafer cleaning apparatus 1 of the present invention. The wafers 4 are arranged in a line and divided into left section and right section supported on or retained in a supporting tray or a receiving cassette or a suspension frame (not labeled). The supporting tray or receiving cassette or suspension frame is then moved into the rinsing space of the rinsing container 5. Preferably, primary surfaces of the wafers 4 that are to be cleaned are arranged to face the center of the rinsing space. For example, the left and right sections are arranged to have the primary faces of the wafers 4 confronting each other as indicated by arrows of FIG. 10.

A control unit, such as a programmable logic control (PLC) based device, may be incorporated in the wafer cleaning apparatus 1 for controlling the operations of the nozzles 61, 62, 63 and 64 and the positioning means 7 whereby the cleaning operation may be performed fully automatically.

Figure 11A:
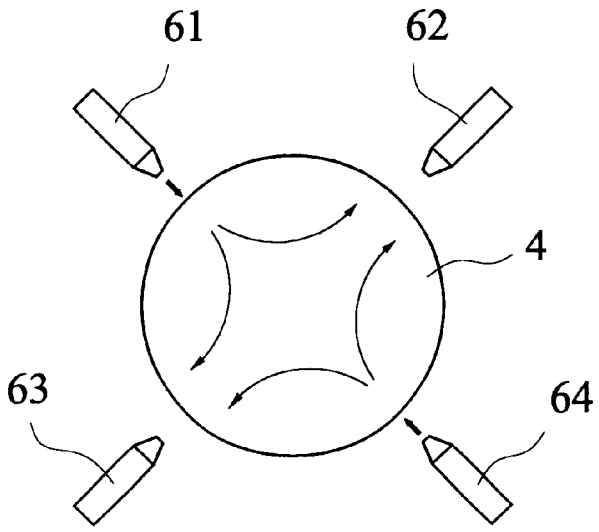
FIGS. 11A and 11B are schematic views showing the water flows created by the wafer cleaning apparatus of the present invention.
Figure 11B:
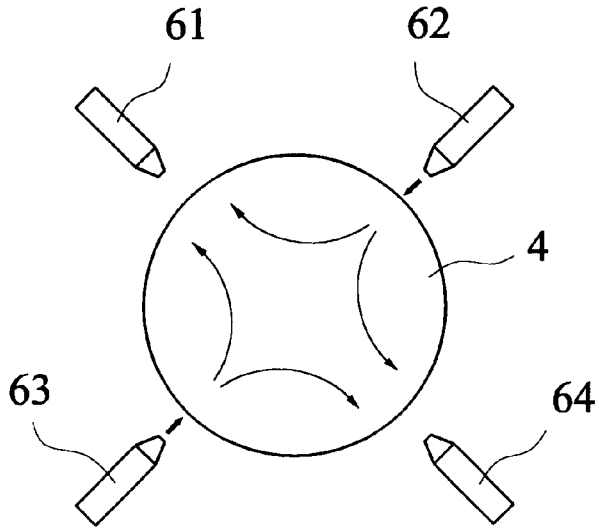

FIGS. 11A and 11B schematically show water flows caused by the nozzles 61, 62, 63 and 64 in the first and second phases. In the first phase (FIG. 11A), the first and fourth nozzles 61 and 64 are turned on, causing water flows in a diagonal direction between the second and third nozzles 62 and 63. In the second phase (FIG. 11B), the second and third nozzles 62 and 63 are turned on, causing water flow in a diagonal direction between the first and the fourth nozzles 61 and 64. By only turning on the diagonally opposite nozzles (61 and 64) or (62 and 63) at a time, the water flows may not be canceled by each other and a stronger flow may be obtained for more effectively removing contaminants from the wafers 4. This also helps reducing water consumption for only two sets of nozzles are turned on each time.

By means of alternately and repeatedly performing the first, second and third phases of the cleaning operation, the most efficient cleaning of the wafers 4 may be obtained. This is also applicable to other disk-like articles, such as optic discs, compact discs (CDs), which require a highly cleaned surface.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A method for cleaning wafers in a wafer cleaning apparatus, the wafer cleaning apparatus comprising a container having an open top side and first, second third and fourth water jet generating means arranged in the container for generating water jets, the method comprising the following steps:

(a) moving wafers to be cleaned into the rising container to a position between the water jet generating means;

(b) generating water jets in opposite directions toward the wafers by the first and fourth water jet generating means for a predetermined first time period;

(c) generating water jets in opposite directions toward the wafers by the second and third water jet generating means for a predetermined second time period; and (d) generating water jets by the third and fourth water jets generating means to cause a water flow in a direction from a bottom of the container toward the open top side of the container; and further comprising a step of continuously generating a water flow from a bottom of the rinsing container toward the open top side when the wafers are moved into the rising container.

2. The method as claimed in claim 1, further comprising a step of moving at least some of the waterjet generating means away from the rinsing container for facilitating moving the wafers into the rinsing container.

3. The method as claimed in claim 1, further comprising a step of moving at least some of the water jet generating means away from the rising container for facilitating moving the wafers out of the rising container after the wafers are cleaned.

4. The method as claimed in claim 1, wherein the wafers are arranged to face a center of a rinsing space defined in the rinsing container when the wafers are positioned in the rinsing container.

5. The method as claimed in claim 1, wherein the first, second, third and fourth water jet generating means are controlled by a PLC based control device to generate water jets toward the wafers.

* * * * *